US006806042B2

(12) United States Patent
Weimann et al.

(10) Patent No.: US 6,806,042 B2
(45) Date of Patent: Oct. 19, 2004

(54) COLOR PHOTOGRAPHIC PRINT MATERIAL

(75) Inventors: Ralf Weimann, Leverkusen (DE); Markus Geiger, Cologne (DE); Cuong Ly, Cologne (DE); Klaus Sinzger, Leverkusen (DE); Beate Weber, Leichlingen (DE); Heinz Wiesen, Kieselweg (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 10/612,132

(22) Filed: Jul. 2, 2003

(65) Prior Publication Data

US 2004/0023171 A1 Feb. 5, 2004

(30) Foreign Application Priority Data

Jul. 10, 2002 (DE) ..... 102 30 978

(51) Int. Cl.[7] ..... G03C 1/08; G03C 7/26; G03C 7/32

(52) U.S. Cl. ..... 430/551; 430/552; 430/553; 430/546; 430/567; 430/631; 430/384; 430/385

(58) Field of Search ..... 430/551–3, 546, 430/567, 631, 384–5

(56) References Cited

U.S. PATENT DOCUMENTS

| | | | | |
|---|---|---|---|---|
| 5,922,526 | A | 7/1999 | Missfeldt | 430/584 |
| 6,534,254 | B1 * | 3/2003 | Helling et al. | 430/552 |
| 6,558,887 | B2 * | 5/2003 | Helling et al. | 430/552 |
| 2002/0051945 | A1 | 5/2002 | Begley et al. | |
| 2003/0064331 | A1 | 4/2003 | Ly et al. | 430/552 |

FOREIGN PATENT DOCUMENTS

| | | |
|---|---|---|
| DE | 196 46 855 | 5/1998 |
| DE | 100 55 094 | 5/2002 |
| EP | 0 571 959 | 12/1993 |
| EP | 1 113 327 | 7/2001 |
| EP | 1 113 329 | 7/2002 |
| EP | 1 363 162 | 11/2003 |
| GB | 2 316 495 | 2/1998 |

* cited by examiner

*Primary Examiner*—Geraldine Letscher
(74) *Attorney, Agent, or Firm*—Connolly Bove Lodge & Hutz LLP

(57) ABSTRACT

A print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the red-sensitive layer contains at least one oil former, the cyan coupler is of the formula (I)

in which $R^1$ means a hydrogen atom or an alkyl group, $R^2$ means an alkyl, aryl or hetaryl group, $R^3$ means an alkyl or aryl group, $R^4$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom and Z means a hydrogen atom or a group eliminable under the conditions of chromogenic development, and the ratio by weight of oil former to cyan coupler is less than 1:1, is distinguished by excellent colour reproduction.

11 Claims, No Drawings

COLOR PHOTOGRAPHIC PRINT MATERIAL

This invention relates to a colour photographic print material having a novel cyan coupler.

Colour photographic print materials are in particular materials for reflection prints or displays, which most usually exhibit a positive image. They are thus not a recording material like colour photographic films. They predominantly comprise negative-working materials.

Colour photographic print materials conventionally contain at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler.

U.S. Pat. No. 5,686,235 disclosed cyan couplers which, once developed with the standard paper developer CD3, yield cyan dyes which are distinguished by good light and dark stability.

However, these couplers have the disadvantage that the dyes are inadequate with regard to colour reproduction.

The couplers have a 2-acylamino-5-phenylsulfonylmethylcarbonylaminophenol structure and may be substituted on the methyl group by alkyl and on the phenyl residue by various groups.

The object of the invention was to overcome the above-stated disadvantage. This is surprisingly achieved with the novel cyan couplers defined below, while retaining the advantages of the prior art coupler.

However, colour reproduction with the new couplers is still inadequate for very demanding applications, such as for example professional photography.

A further object of the invention was accordingly to eliminate this disadvantage too. This is surprisingly achieved with the novel cyan coupler defined below if it is used together with a small quantity of an oil former.

The present invention accordingly provides a print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the red-sensitive layer contains at least one oil former, the cyan coupler is of the formula (I)

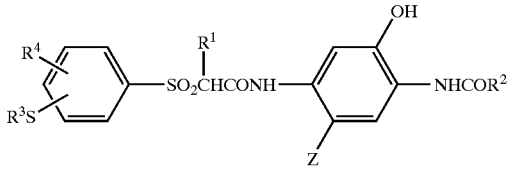

in which $R^1$ means a hydrogen atom or an alkyl group, $R^2$ means an alkyl, aryl or hetaryl group, $R^3$ means an alkyl or aryl group, $R^4$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom and Z means a hydrogen atom or a group eliminable under the conditions of chromogenic development, and the ratio by weight of oil former to cyan coupler is less than 1:1.

The following meanings preferably apply:

$R^1$=an alkyl group;

$R^2$=unsubstituted or substituted phenyl, thienyl or thiazolyl group;

$R^3$=alkyl group;

$R^4$=hydrogen atom;

Z=Cl.

The oil former according to the invention may comprise a high-boiling organic solvent and/or a polymer.

The cyan coupler is particularly preferably of the formula (I-A)

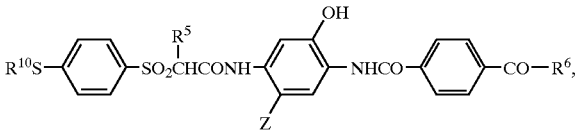

in which $R^5$ means a hydrogen atom or an alkyl group, $R^6$ means $OR^7$ or $NR^8R^9$, $R^7$ means an unsubstituted or substituted alkyl group with 1 to 6 C atoms, $R^8$ means an unsubstituted or substituted alkyl group with 1 to 6 C atoms, $R^9$ means a hydrogen atom or an unsubstituted or substituted alkyl group with 1 to 6 C atoms, $R^{10}$ means an unsubstituted or substituted alkyl group and Z means a hydrogen atom or a group eliminable under the conditions of chromogenic development and wherein the total number of the C atoms of the alkyl groups $R^7$ to $R^{10}$ in a coupler molecule is 8 to 18.

The alkyl groups can be straight chain, branched or cyclic and the alkyl, aryl and hetaryl groups can be substituted, for example, by alkyl, alkenyl, alkyne, alkylene, aryl, heterocyclyl, hydroxy, carboxy, halogen, alkoxy, aryloxy, heterocyclyloxy, alkylthio, arylthio, heterocyclylthio, alkylseleno, arylseleno, heterocyclylseleno, acyl, acyloxy, acylamino, cyano, nitro, amino, thio or mercapto groups, wherein a heterocyclyl represents a saturated, unsaturated or aromatic heterocyclic radical and an acyl represents the radical of an aliphatic, olefinic or aromatic carboxylic, carbamic, carbonic, sulphonic, amidosulphonic, phosphoric, phosphonic, phosphorous, phosphinic or sulphinic acid.

Preferably the alkyl groups can be substituted, for example, by alkyl, alkylene, hydroxy, alkoxy or acyloxy groups and most preferably by hydroxy or alkoxy groups. Preferred substituents for aryl and hetarylgroups are halogen, in particular Cl and F, alkyl, fluorinated alkyl, cyano, acyl, acylamino or carboxy groups.

Suitable Cyan Couplers are:
I-1
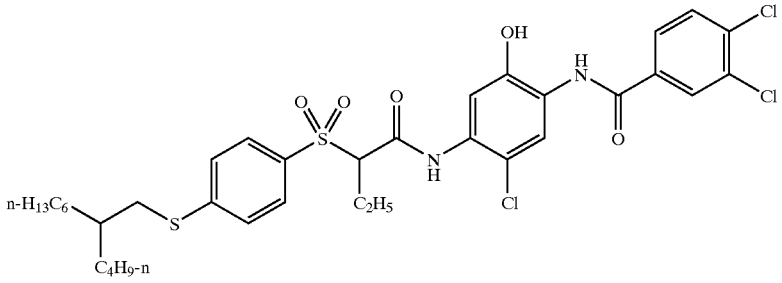
I-2
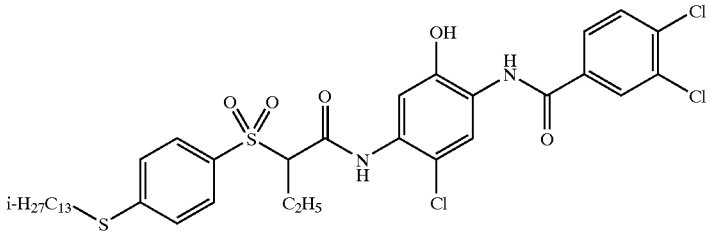
I-3
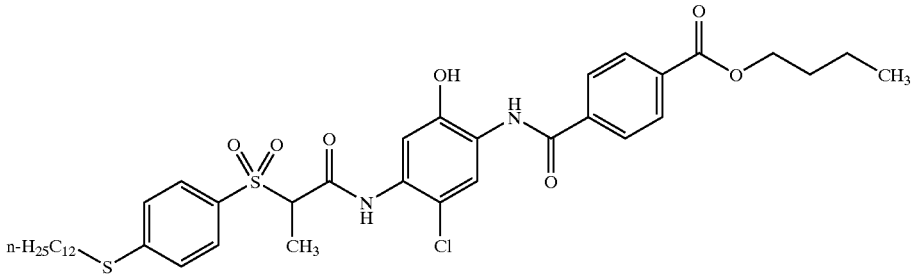
I-4
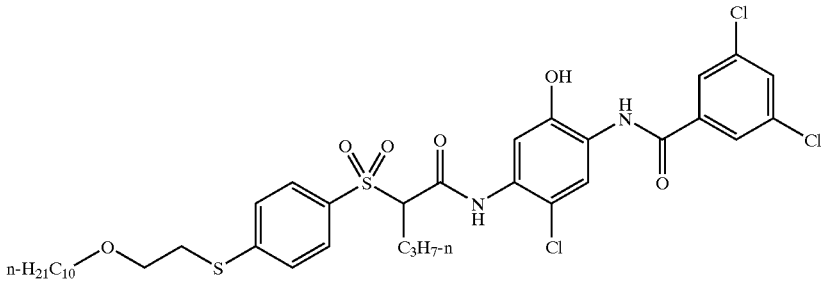
I-5
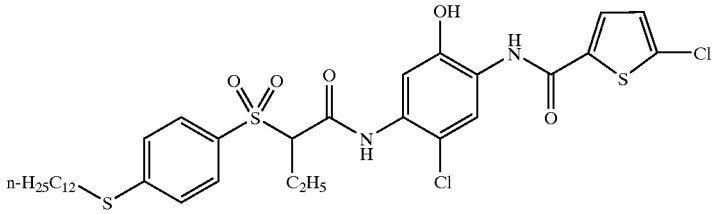
I-6
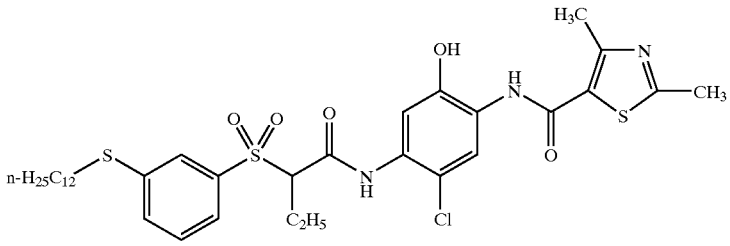

-continued
I-7
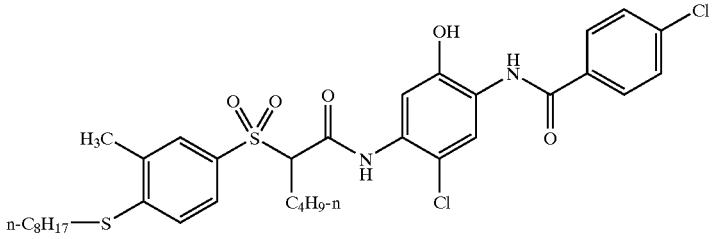
I-8
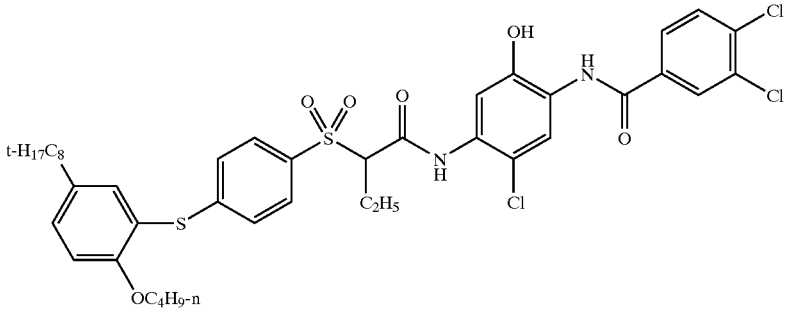
I-9
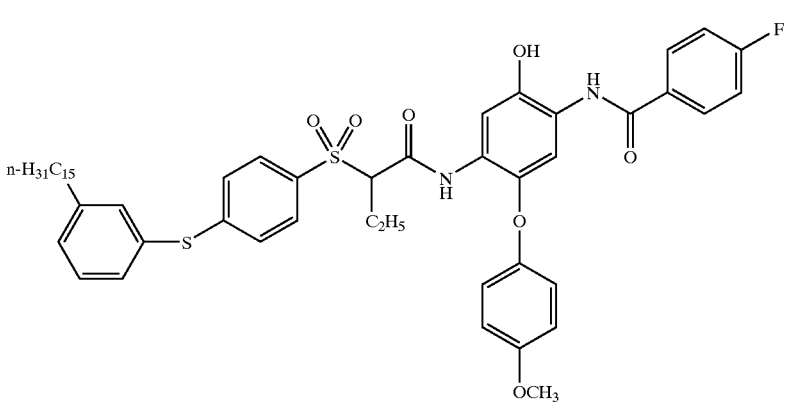
I-10
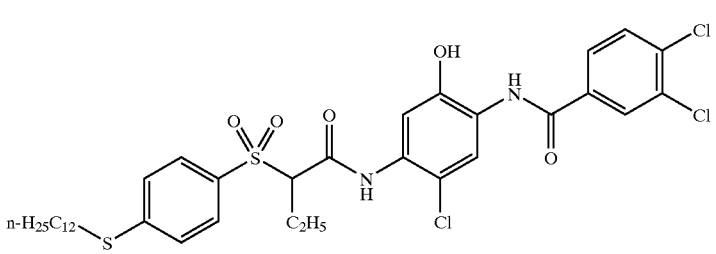
I-11
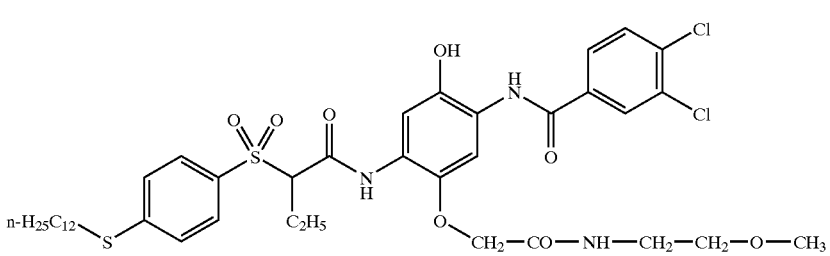

-continued
I-12
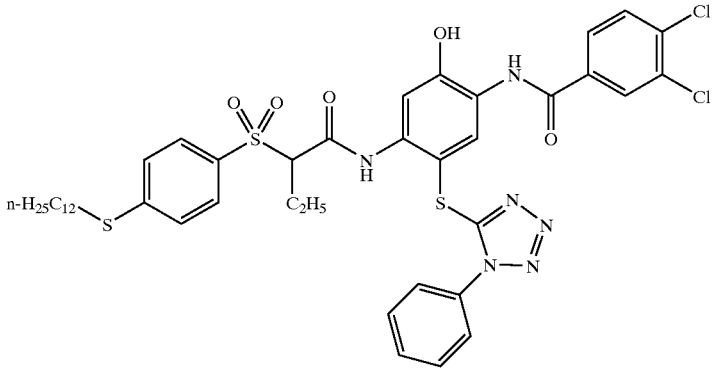
I-13
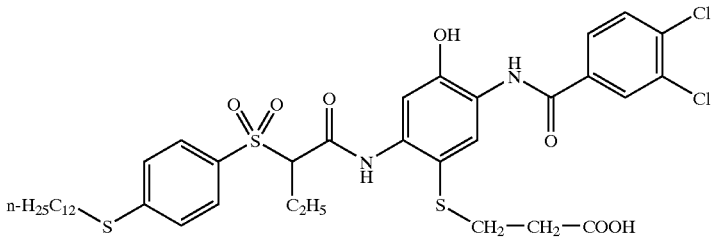
I-14
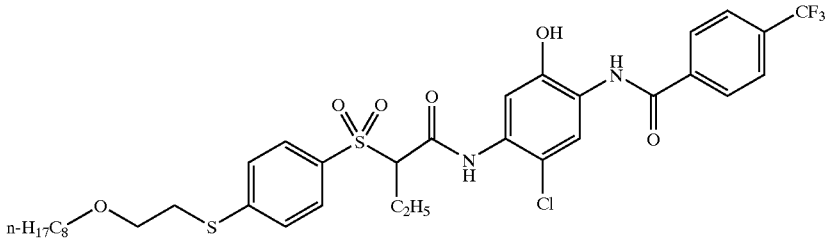
I-15
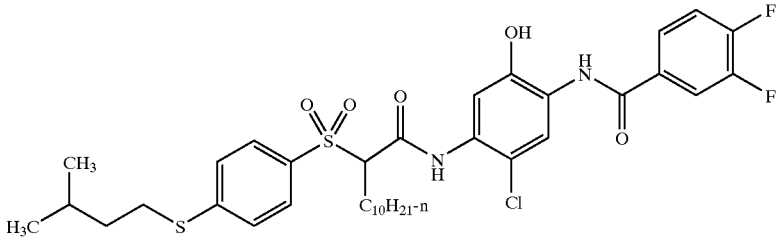
I-16
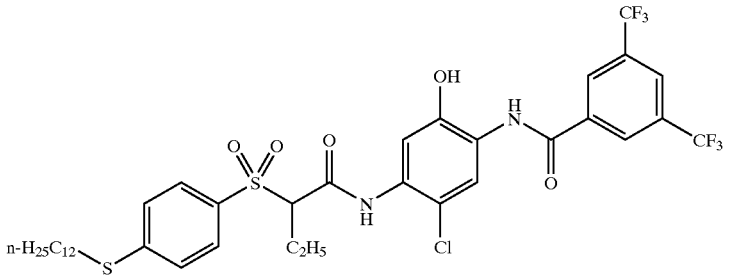
I-17
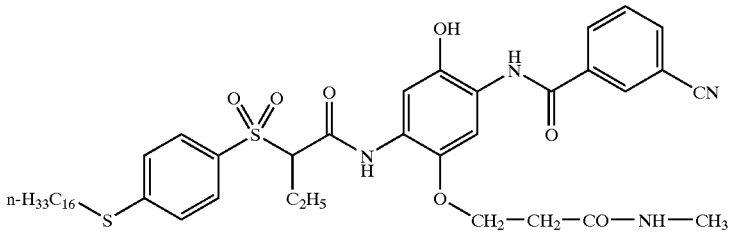

-continued
I-18
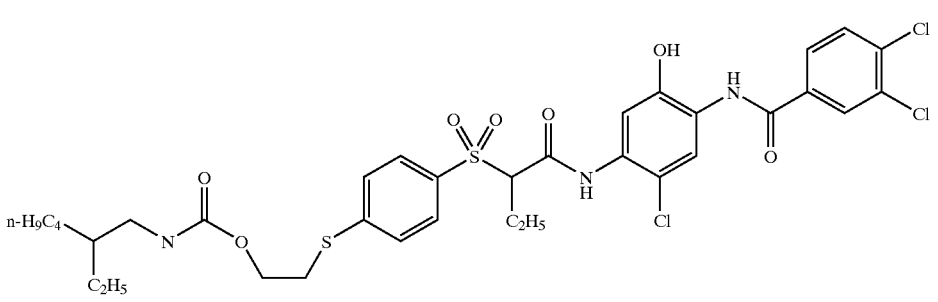
I-19
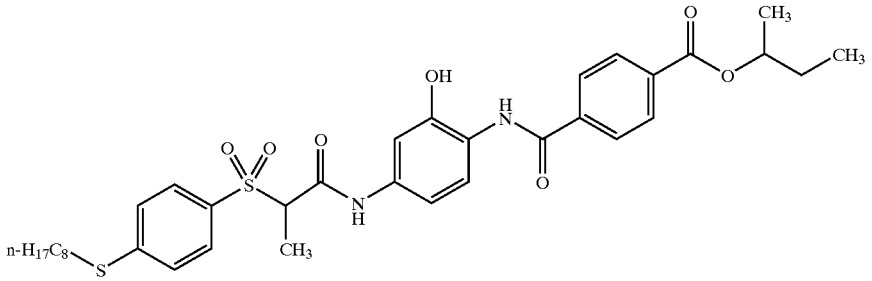
I-20
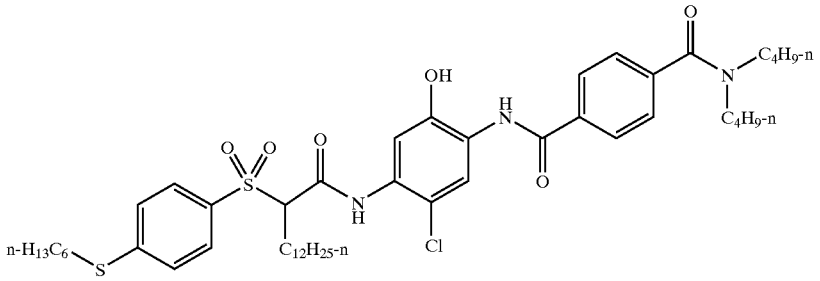
I-21
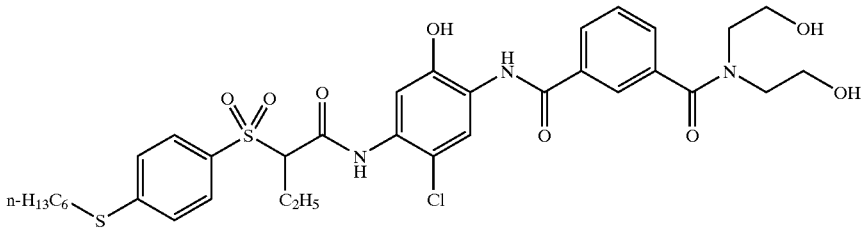
I-22
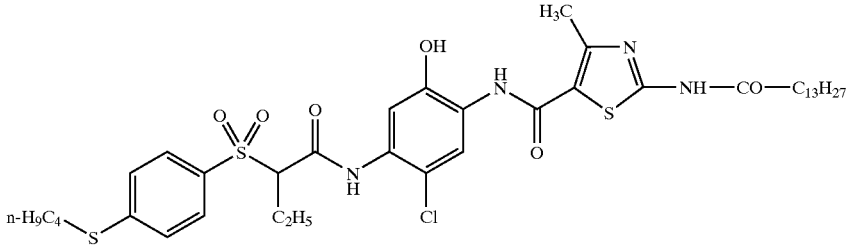
I-23
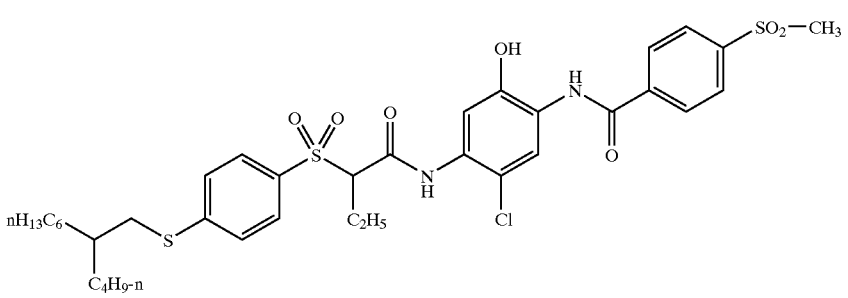

-continued
I-24
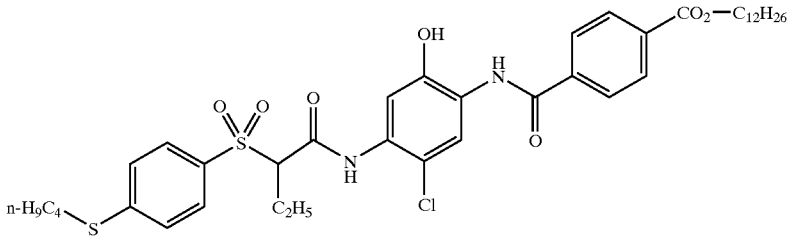
I-25
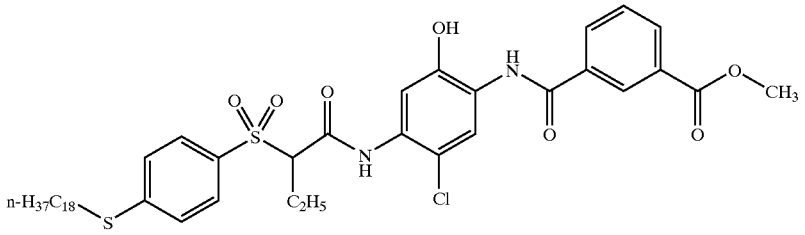
I-26
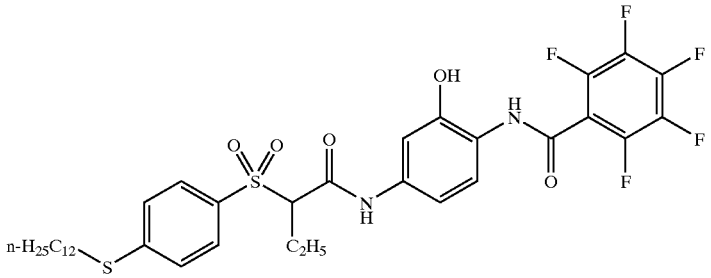
I-27
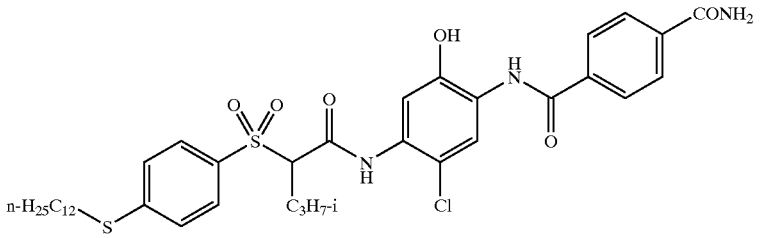
I-28
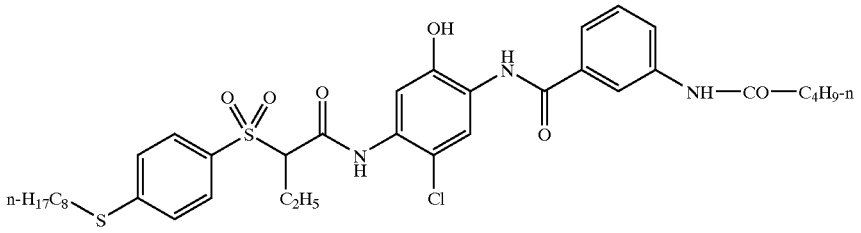
I-29
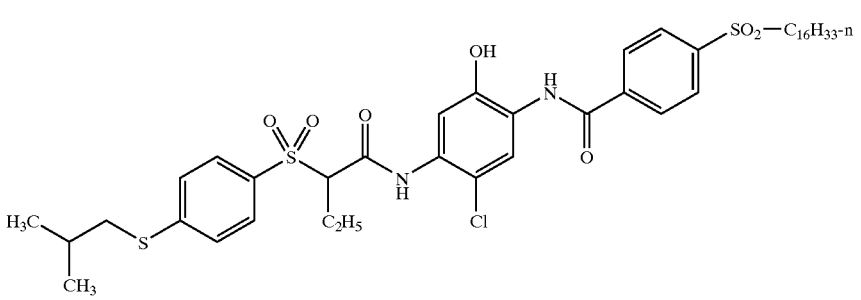

-continued
I-30
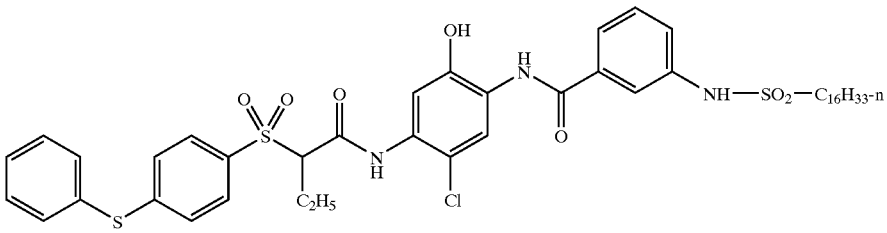
I-31
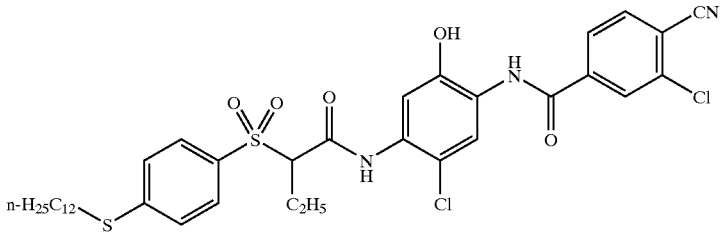
I-32
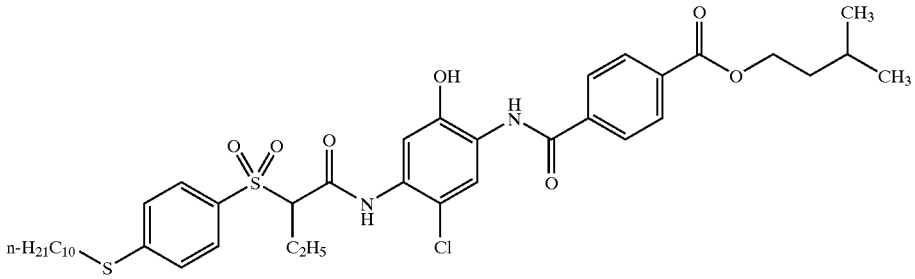
I-33
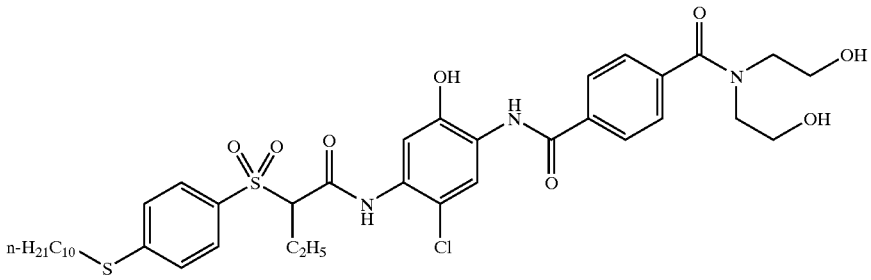
I-34
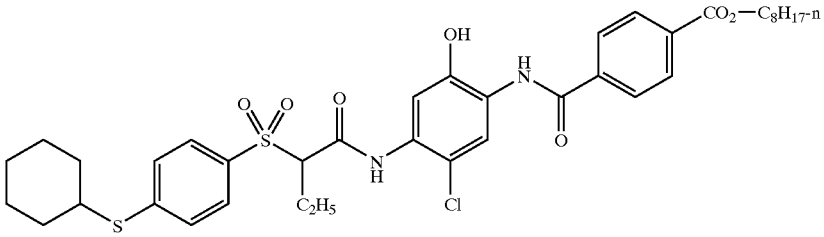
I-35
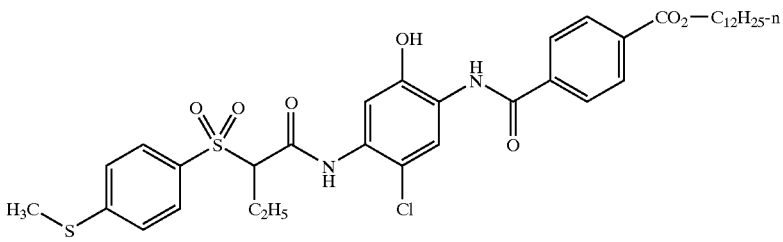

-continued
I-36
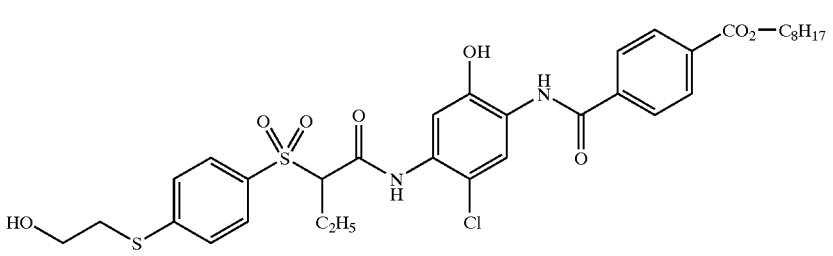
I-37
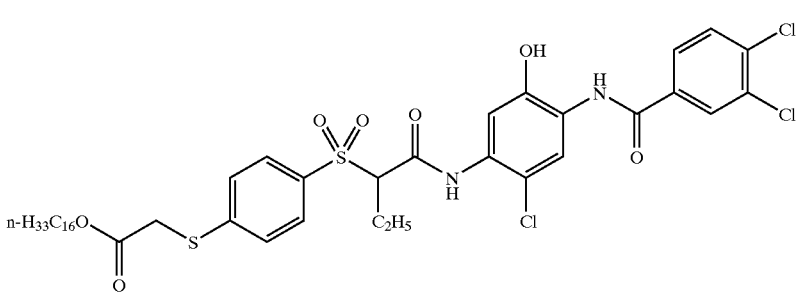
I-38
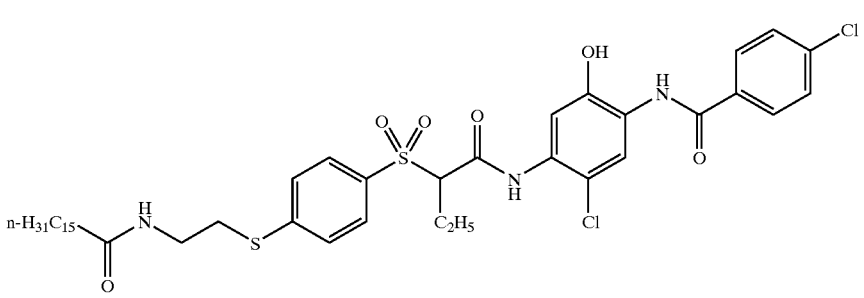
I-39
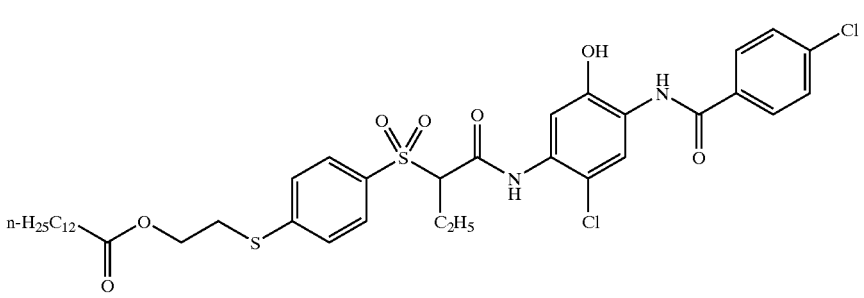
I-40
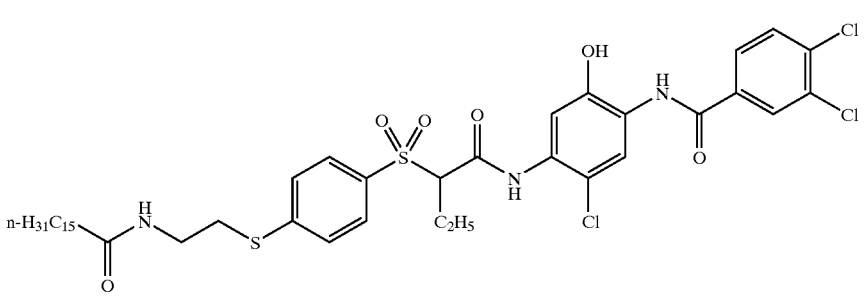

Synthesis of Coupler I-10

Synthesis of the Phenolic Coupler Intermediate

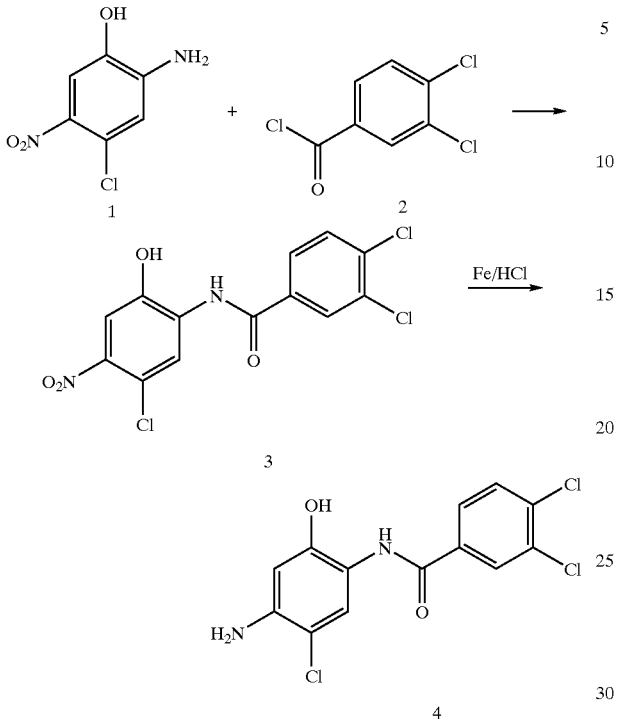

-continued

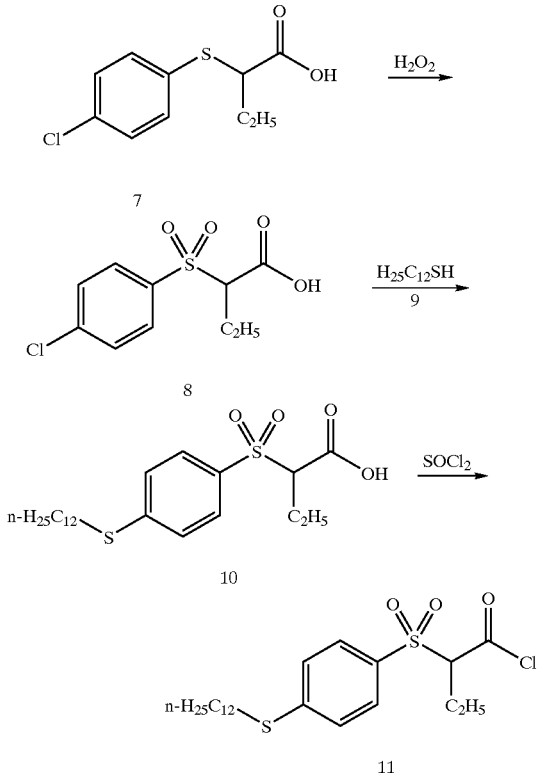

A solution of 185 g (0.87 mol) of 3,4-dichlorobenzoyl chloride 2 in 50 ml of N-methylpyrrolidone is added dropwise with stirring to 165 g (0.87 mol) of 2-amino-4-chloro-5-nitrophenol 1 in 500 ml of N-methylpyrrolidone. Continue stirring for 1 hour at room temperature and then for 2 hours at 60–65° C. After cooling, slowly combine with 500 ml of water and suction filter. Stir twice with water and then twice with methanol and suction filter.

Yield 310 g (98%) of 3

A mixture of 310 g (0.86 mol) of 3, 171 g of iron powder, 2.2 l of ethanol and 700 ml of N-methylpyrrolidone is heated to 65° C. while being stirred. The heating bath is removed and 750 ml of conc. hydrochloric acid are added dropwise within 2 hours. The mixture is then refluxed for 1 hour. After cooling, 1 l of water is added, the mixture suction filtered and washing performed with 2 N hydrochloric acid, then with water until the outflowing water is colourless. The residue is stirred together with 1.5 l of water, the mixture neutralised by addition of sodium acetate and suction filtered. Stir twice more with 1.5 l of methanol and suction filter.

Yield 270 g (95%) of 4

Synthesis of the ballast residue

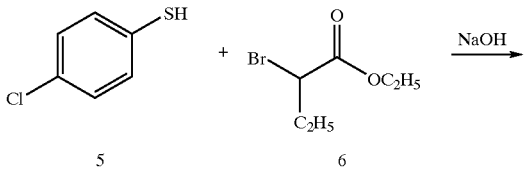

320 g (3.6 mol) of 45% sodium hydroxide solution are added dropwise within 1 hour with stirring to a mixture of 520 g (3.6 mmol) of 4-chlorothiophenol 5 and 652 g (3.6 mol) of 2-bromobutyric acid ethyl ester 6 in 1 l of ethanol. The reaction is strongly exothermic, the temperature being kept at 75–80° C. by cooling, and the mixture is then refluxed for 1 hour. A further 400 g (4.5 mol) of sodium hydroxide solution are slowly added dropwise (weakly exothermic). After refluxing for a further 2 hours, the mixture is cooled and 1 l of water is added. Extraction is then performed twice with 250 ml of toluene, the combined organic phases are dried and evaporated in the rotary evaporator. The viscous oil 7 (830 g, still contains toluene) is further reacted without purification.

760 ml of hydrogen peroxide (35%) are added dropwise to a solution of 830 g (3.6 mol) of compound 7 and 10 ml of sodium tungstate solution (20%) in glacial acetic acid: the first 300 ml initially with cooling at 35–40° C. and, after removal of the cooling, the remaining 360 ml at 90–95° C. Once addition is complete, stirring is continued for 1 hour at this temperature. Excess peroxide is destroyed by addition of sodium sulfite. The reaction mixture is combined with 2 l of ethyl acetate and 2 l of water, the organic phase is separated and the aqueous phase extracted twice with 700 ml portions of ethyl acetate. The combined organic phases are washed twice with 700 ml portions of water, dried and evaporated under a vacuum. The residue is dissolved in 300 ml of hot ethyl acetate, cooled and, at the onset of crystallisation, combined with 1 l of hexane. The mixture is then suction filtered when cold and rewashing performed with a little hexane. 835 g (88%) of the compound 8 are obtained.

131 g (0.5 mol) of 8 and 111 g (0.55 mol) of dodecyl mercaptan 9 in 300 ml of 2-propanol are combined with stirring with 90 g (1 mol) of sodium hydroxide solution (45%). After the addition of 2.5 g of tetrabutylammonium bromide and 2.5 g of potassium iodide, the mixture is refluxed for 11 hours. After cooling, 350 ml of water are added and the pH is adjusted to 1–2 with approx. 60 ml of conc. hydrochloric acid. Extraction is then performed twice with 100 ml portions of ethyl acetate, the combined organic phases are washed three times with 150 ml portions of water, dried and evaporated. The residue is stirred together with 500 ml of hexane and the mixture suction filtered at 0–5° C. After recrystallisation from 500 ml of hexane/ethyl acetate (10:1), 177 g of 10 are obtained (82%, m.p.: 82° C.).

128 g (0.3 mol) of 10 and 1 ml of dimethylformamide are heated to 65° C. in 300 ml of toluene. 75 ml (1 mol) of thionyl chloride are added dropwise at this temperature within 1 hour. After a further 5 hours, the mixture is evaporated under a vacuum. The highly viscous oil (11, 134 g) is used without further purification.

Synthesis of Coupler I-10

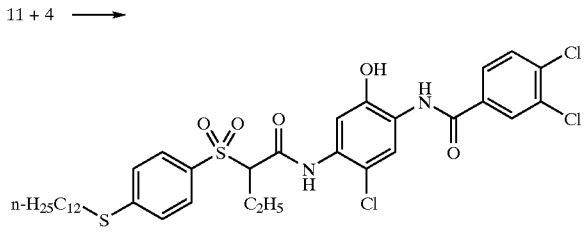

1-10

100 g of the crude product 11 (approx. 0.2 mol) in 100 ml of N-methylpyrrolidone are added dropwise at 5–10° C. to 66 g (0.2 mol) of 4 in 200 ml of N-methylpyrrolidone. The mixture is stirred, initially for 2 hours at room temperature, then for 2 hours at 60° C. The reaction mixture is filtered while hot, the filtrate combined with 500 ml of acetonitrile, cooled to 0° C., suction filtered and rewashed with 50 ml of acetonitrile. The product is combined with 500 ml of methanol and 1 l of water, stirred, suction filtered, then rewashed with 300 ml of water and dried.

Yield: 120 g (81%) of I-10

The red-sensitive layer preferably contains silver halide crystals with a chloride content of at least 95 mol %, wherein they in particular comprise silver chloride, silver chloride-bromide, silver chloride-iodide or silver chloride-bromide-iodide crystals. The emulsions particularly preferably comprise silver chloride-bromide emulsions with a chloride content of at least 95 mol % and particularly preferably of at least 97 mol %.

The silver halide crystals of the print material according to the invention and in particular those of the red-sensitive layer are preferably doped with iridium. The iridium may be incorporated into the crystals in any known manner. It is preferably added as a complex salt in dissolved form at any desired point during emulsion production, in particular before completion of crystal formation.

In a preferred embodiment, iridium(III) and/or iridium (IV) complexes are used, wherein complexes comprising chloro ligands are preferred. Hexachloroiridium(III) and hexachloroiridium(IV) complexes are particularly preferred. The counterions optionally required to offset the charge of the iridium complex ions have no influence on the action according to the invention and may be selected at will.

The ratio by weight of oil former to cyan coupler is preferably greater than 0.05:1 (0.05 g of oil former per 1 g of cyan coupler), in particular between 0.2:1 and 0.9:1 and particularly preferably between 0.3:1 and 0.8:1.

In an advantageous embodiment of the invention, the oil former comprises a high-boiling organic solvent.

Suitable high-boiling, organic solvents are for example phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of particularly suitable high-boiling, organic solvents are dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl p-hydroxybenzoate, diethyldodecanamide, N-tetradecyclpyrrolidone, isostearyl alcohol, 2,4-di-t-amylphenol, dioctyl acetate, glycerol tributyrate, isostearyl lactate, trioctyl citrate, N,N-dibutyl-2-butoxy-5-t-octylaniline, paraffin, dodecylbenzene, diisopropylnaphthalene, tetradecanol, bis-(2-ethylhexyl) sebacate, dibutyl adipate and diisononyl adipate.

It is particularly advantageous to emulsify the cyan coupler with the high-boiling organic solvent and to add the emulsified mixture to the red-sensitive layer.

In another advantageous embodiment of the invention, the oil former comprises a homo- or copolymer, hereinafter also simply designated "the polymer", which is insoluble in water and soluble in organic solvents.

The polymer preferably contains no acidic groups, which are also designated acid groups. Acid groups should be taken to mean substituents such as carboxylic acid groups, sulfonic acid groups or acidic phenol groups which have a pKa value of less than or equal to 10.

The homo- or copolymer which is insoluble in water and soluble in organic solvents in particular comprises a vinyl polymer or a polyester.

Vinyl polymers may in particular contain the following monomer units:

Acrylic acid esters such as for example methyl acrylate, ethyl acrylate, n-propyl acrylate, iso-propyl acrylate, n-butyl acrylate, iso-butyl acrylate, sec-butyl acrylate, tert-butyl acrylate, amyl acrylate, hexyl acrylate, 2-ethylhexyl acrylate, 5-octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, co-methoxypolyethylene glycol acrylate (number of units n=9), 1-bromo-2-methoxyethyl acrylate and 1,1-dichloro-2-ethoxyethyl acrylate.

Methacrylic acid esters such as for example methyl methacrylate, ethyl methacrylate, n-propyl methacrylate, iso-propyl methacrylate, n-butyl methacrylate, iso-butyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-methoxyethoxy)ethyl methacrylate, 2-(2-butoxyethoxy)ethyl methacrylate, ω-methoxypolyethylene glycol methacrylate (number of units n=6), allyl methacrylate and methacrylic acid dimethylaminoethylmethyl chloride.

Vinyl esters such as for example vinyl acetate, vinyl propionate, vinyl butyrate, vinyl isobutyrate, vinyl caproate, vinyl chloroacetate, vinyl methoxyacetate, vinyl phenylacetate, vinyl benzoate and vinyl salicylate.

Acrylamides such as for example acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl) acrylamide and diacetoacrylamide.

Methacrylamides such as for example methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetoacetoxyethyl)methacrylamide.

Olefins such as for example dicyclopentadiene, ethylene, propylene, 1-butene, 1-pentene, vinyl chloride, vinylidene chloride, isoprene, chloroprene, butadiene and 2,3-dimethylbutadiene.

Styrene compounds such as for example styrene, methylstyrene, dimethylstyrene, trimethylstyrene, ethylstyrene, iso-propylstyrene, chloromethylstyrene, methoxystyrene, acetoxystyrene, chlorostyrene, dichlorostyrene, bromostyrene and vinylbenzoic acid methyl ester.

Vinyl ethers such as for example methyl vinyl ether, butyl vinyl ether, hexyl vinyl ether, methoxyethyl vinyl ether and dimethylaminoethyl vinyl ether.

Further monomers such as for example butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, vinylidene chloride, methylene malonitrile and vinylidene.

The copolymers according to the invention contain two or more different monomers, for example those stated above, by means of the selection of which it is possible to influence polymer properties, for example the coupler dissolving power thereof. In order to improve colour formation, the copolymers may also contain monomers with acidic groups, providing that the copolymer does not consequently become water-soluble.

Suitable monomers with acidic groups are, for example, acrylic acid, methacrylic acid, itaconic acid, maleic acid; monoalkyl itaconic acid salts such as monomethyl itaconate, monoethyl itaconate, monobutyl itaconate; monoalkyl maleic acid salts such as monomethyl maleate, monoethyl maleate, monobutyl maleate; citraconic acid, styrenesulfonic acid, vinylbenzylsulfonic acid, vinylsulfonic acid; acryloyloxyalkylsulfonic acids such as acryloyloxymethylsulfonic acid, acryloyloxyethylsulfonic acid, acryloyloxypropylsulfonic acid; methacryloyloxyalkylsulfonic acids such as methacryloyloxymethylsulfonic acid, methacryloyloxyethylsulfonic acid, methacryloyloxypropylsulfonic acid; acrylamidoalkylsulfonic acids such as 2-acrylamido-2-methylethanesulfonic acid, 2-acrylamido-2-methylpropanesulfonic acid, 2-acrylamido-2-methylbutanesulfonic acid; methacrylamidoalkylsulfonic acids such as 2-methacrylamido-2-methylethanesulfonic acid, 2-methacrylamido-2-methylpropanesulfonic acid, 2-methacrylamido-2-methylbutanesulfonic acid together with alkali metal salts, for example of Na and K, or ammonium salts of the acids.

The proportion of water-soluble monomers in the polymer is preferably at most 40 mol %, in particular at most 20 mol % and particularly preferably at most 10 mol %.

Of the stated vinyl monomers, methacrylic acid esters and acrylamides and in particular alkylacrylamides are particularly preferred.

In one particularly advantageous embodiment of the invention, the polymer comprises a polyalkylacrylamide.

The polyester according to the invention may be obtained by condensation of a polyhydroxy alcohol with a polycarboxylic acid or a polycarboxylic acid derivative.

Polyhydroxy alcohols which may be considered are, for example, polyalkylene glycols of the structure HO—$R^1$—OH, wherein $R^1$ denotes a hydrocarbon chain, in particular an alkylene chain with 2 to approx. 12 carbon atoms, while polycarboxylic acids which may be considered are, for example, compounds of the structure HOOC—$R^2$—COOH and the derivatives thereof, wherein $R^2$ denotes a single bond or a hydrocarbon chain with 1 to approx. 12 carbon atoms.

Suitable examples of polyhydroxy alcohols are, for example, ethylene glycol, diethylene glycol, triethylene glycol, 1,2-propylene glycol, 1,3-propylene glycol, trimethylolpropane, 1,4-butanediol, isobutylene, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerol, diglycerol, triglycerol, 1-methylglycerol, erythritol, mannitol and sorbitol.

Suitable examples of polycarboxylic acids are, for example, oxalic acid, succinic acid, glutaric acid, adipic acid, pimelic acid, suberic acid, azelaic acid, sebacic acid, nonanoic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isopimelic acid, cyclopentadiene/maleic anhydride adduct and rosin/maleic anhydride adduct.

The molecular weight of the polymer according to the invention is preferably between 1,000,000 and 2,000, in particular between 400,000 and 5,000 and particularly preferably between 150,000 and 10,000.

Instead of one polymer according to the invention, it is also advantageously possible to use a mixture of two or more polymers, wherein the mixture may also contain polymers other than those according to the invention, providing that the proportion thereof is sufficiently low for the advantages according to the invention to be retained.

Suitable polymers according to the invention are listed below. In the case of copolymers, the molar proportions of the various monomers are stated. If no proportion is stated, the monomers are present in equal proportions.

P-1 polyvinyl acetate
P-2 polyvinyl propionate
P-3 polymethyl methacrylate
P-4 polyethyl methacrylate
P-5 polyethyl acrylate
P-6 polyheptyl acrylate
P-7 polybutyl acrylate
P-8 polybutyl methacrylate
P-9 polyisobutyl methacrylate
P-10 polyisopropyl methacrylate
P-11 polyoctyl acrylate
P-12 polyhexadecyl acrylate
P-13 polyhexyl acrylate
P-14 polyisobutyl acrylate
P-15 polyisopropyl acrylate
P-16 poly-3-methoxybutyl acrylate
P-17 poly-2-methoxyethyl acrylate
P-18 poly-4-methoxyphenyl acrylate
P-19 poly-3-methoxypropyl acrylate
P-20 polymethyl acrylate
P-21 polydecyl methacrylate
P-22 polydodecyl methacrylate
P-23 polydiethylaminoethyl methacrylate
P-24 polyethyl methacrylate
P-25 polyhexadecyl methacrylate
P-26 polyhexyl methacrylate
P-27 polydimethylaminoethyl methacrylate
P-28 poly-3,3-dimethylbutyl methacrylate
P-29 poly-3,3-dimethyl-2-butyl methacrylate
P-30 poly-3,5,5-trimethylhexyl methacrylate
P-31 polyoctadecyl methacrylate
P-32 polytetradecyl methacrylate
P-33 polypentyl acrylate
P-34 polypentyl methacrylate
P-35 polyethylethoxycarbonyl methacrylate
P-36 poly-N-sec-butylacrylamide
P-37 poly-N-tert-butylacrylamide
P-38 polyethyl ethacrylate
P-39 polycyclohexyl methacrylate
P-40 poly-tert-butyl methacrylate
P-41 poly-iso-butyl chloroacrylate
P-42 poly-N-tert-butylmethacrylamide
P-43 polymethylphenyl acrylate
P-44 polybenzyl acrylate
P-45 poly-sec-butyl acrylate
P-46 poly-tert-butyl acrylate
P-47 poly-2-tert-butylphenyl acrylate
P-48 poly-4-tert-butylphenyl acrylate
P-49 poly-2-methylbutyl acrylate
P-50 poly-3-methylbutyl acrylate
P-51 poly-1,3-dimethylbutyl acrylate
P-52 poly-2-methylpentyl acrylate
P-53 polyphenyl acrylate
P-54 polypropyl acrylate
P-55 poly-m-toluoyl acrylate
P-56 poly-o-toluoyl acrylate
P-57 poly-p-toluoyl acrylate
P-58 poly-N-butylacrylamide
P-59 poly-N,N-dibutylacrylamide
P-60 poly-N-iso-hexylacrylamide
P-61 poly-N-iso-octylacrylamide
P-62 poly-N-methyl-N-phenylacrylamide
P-63 polybenzyl methacrylate
P-64 poly-2-N-tert-butylaminoethyl methacrylate
P-65 poly-sec-butyl methacrylate
P-66 ethylene glycol/sebacic acid polyester
P-67 vinyl acetate/vinyl alcohol copolymer (95/5)
P-68 butyl acrylate/acrylamide copolymer (95/5)
P-69 stearyl methacrylate/acrylic acid copolymer (90/10)
P-70 methyl methacrylate/styrene copolymer (90/10)
P-71 methyl methacrylate/ethyl acrylate copolymer (50/50)
P-72 butyl methacrylate/methyl methacrylate/styrene copolymer (50/30/20)
P-73: vinyl acetate/acrylamide copolymer (85/15)
P-74 diacetoneacrylamide/methyl methacrylate copolymer (50/50)
P-75 methyl vinyl ketone/iso-butyl methacrylate copolymer (55/45)
P-76 ethyl methacrylate/butyl acrylate (70/30)
P-77 diacetoneacrylamide/butyl acrylate copolymer (60/40)
P-78 methyl methacrylate/styrene/diacetoneacrylamide copolymer (40/40/20)
P-79 butyl acrylate/styrene/diacetoneacrylamide copolymer (70/20/10)
P-80 methyl methacrylate/styrene/vinylsulfonamide copolymer (70/20/10)
P-81 butyl acrylate/methyl methacrylate/butyl methacrylate copolymer (35/35/30)
P-82 methyl methacrylate/butyl methacrylate/iso-butyl methacrylate/acrylic acid copolymer (37/29/25/9)
P-83 butyl methacrylate/acrylic acid copolymer (95/5)
P-84 methyl methacrylate/acrylic acid copolymer (95/5)
P-85 butyl methacrylate/methyl methacrylate/benzyl methacrylate/acrylic acid copolymer (35/35/25/5)
P-86 cyclohexyl methacrylate/methyl methacrylate/propyl methacrylate copolymer (37/29/34)
P-87 methyl methacrylate/butyl methacrylate copolymer (65/35)
P-88 vinyl acetate/vinyl propionate copolymer (75/25)
P-89 butyl methacrylate/styrene copolymer (90/10)
P-90 N-tert-butylacrylamide/methyl methacrylate copolymer (60/40)
P-91 N-tert-butylacrylamide/ethyl acrylate copolymer (50/50)
P-92 methyl methacrylate/hexyl methacrylate copolymer (70/30)
P-93 poly-N-(1,1-dimethyl-3-oxobutyl)acrylamide
P-94 poly-N-octylmethacrylamide P-95 N,N-diethylacrylamide/butyl acrylate copolymer (40/60)

P-96 N,N-diethylacrylamide/2-butoxyethyl acrylate copolymer (65/35)

P-97 N-tert-butylacrylamide/butyl acrylate copolymer (60/40)

P-98 N-tert-octylacrylamide/2-ethylhexyl acrylate copolymer (65/35)

P-99 N,N-dibutylacrylamide/dibutylmaleic acid copolymer (75/25)

P-100 N-tert-butylacrylamide/butyl acrylate copolymer (45/55)

P-101 N-octyl-N-ethylacrylamide/ethyl acrylate copolymer (45/55)

P-102 N-butylmethacrylamide/2-ethylhexyl acrylate copolymer (90/10)

P-103 N,N-dibutylmethacrylamide/propyl acrylate copolymer (80/20)

P-104 N-(2-phenylethyl)acrylamide/butyl acrylate copolymer (25/75)

P-105 N-acryloylmorpholine/2-ethoxyethyl acrylate copolymer (40/60)

P-106 N-methyl-N'-acryloylpiperazine/butyl acrylate copolymer (15/85)

P-107 N-acryloylpiperidine/2-butoxyethyl acrylate copolymer (40/60)

P-108 N-(1,1-dimethyl-3-hydroxybutyl)acrylamide/2-ethylhexyl ethacrylate copolymer (75/25)

P-109 N-acryloylpiperidine/butyl acrylate copolymer (50/50)

P-110 N-(p-hydroxyphenyl)acrylamide/butyl acrylate copolymer (25/75)

P-111 N-[3-(dimethylamino)propyl]acrylamide/butyl acrylate copolymer (35/65)

P-112 N-methyl-N'-methacryloylpiperazine/2-ethoxyethyl acrylate copolymer (40/60)

P-113 N-tert-butylacrylamide/butyl acrylate/2-ethoxyethyl acrylate copolymer (55/25/20)

P-114 1,6-hexanediol/ascorbic acid/sebacic acid polyester

P-115 diethylene glycol/adipic acid polyester

P-116 trimethylolpropane/adipic acid/phthalic acid polyester

P-117 diethylene glycol/trimethylolpropane/adipic acid polyester

P-118 ethylene glycol/adipic acid polyester

P-119 ethylene glycol/1,4-butanediol/adipic acid polyester

P-120 1,4-bis(β-hydroxyethoxy)benzene/sebacic acid polyester

P-121 ethylene glycol/azelaic acid polyester

P-122 1,4-butanediol/adipic acid polyester

The cyan coupler is preferably emulsified with the polymer and the emulsified mixture is added to the red-sensitive layer.

In another advantageous embodiment of the invention, the red-sensitive layer contains a high-boiling organic solvent and the polymer. The ratio by weight of solvent to polymer may be varied over broad range; it is preferably between 0.02 g of solvent:1 g of polymer to 100 g of solvent:1 g of polymer, in particular between 0.5 g of solvent:1 g of polymer to 3 g of solvent:1 g of polymer.

In a particularly advantageous embodiment of the invention, the cyan coupler is emulsified with the polymer and the high-boiling organic solvent and the emulsified mixture is added to the red-sensitive layer.

In order to produce the above-stated emulsified mixtures, the cyan coupler according to the invention is dissolved or dispersed in the oil former. These solutions or dispersions are then emulsified into an aqueous binder solution, conventionally a gelatine solution, and, after they have been incorporated into the photographic layers and the layers have dried, are present as fine droplets of a diameter of 0.05 to 0.8 μm, in the layers. Further methods for the production of the emulsified mixtures are stated in Research Disclosure 37254, part 6 (1995), page 292.

The present invention also provides a process for the production of a positive reflection print from a colour negative, wherein the image information is exposed onto a print material and the material is subsequently processed in a manner corresponding to its type, which process is characterised in that the above-described print material according to the invention is used.

In a preferred embodiment of the process according to the invention, the colour negative is digitised and exposure is performed with a scanning printer, particular preferably with a laser film recorder.

In a further advantageous embodiment of the process according to the invention, exposure is performed with an analogue printer, particularly preferably with a printer capable of exposing in excess of 1000 prints per hour.

Examples of colour photographic print materials are colour photographic paper, colour reversal photographic paper, semi-transparent display material and colour photographic materials with a deformable substrate, for example made from PVC. A review may be found in Research Disclosure 37038 (1995), Research Disclosure 38957 (1996) and Research Disclosure 40145 (1997).

Photographic print materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627.

The colour photographic print materials conventionally contain at least one red-sensitive, one green-sensitive and one blue-sensitive silver halide emulsion layer, optionally together with interlayers and protective layers.

Depending upon the type of photographic print material, these layers may be differently arranged. This is demonstrated for the most important products:

Colour photographic paper and colour photographic display material conventionally have on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; a yellow filter layer is not necessary.

The number and arrangement of the photosensitive layers may be varied in order to achieve specific results. Colour papers, for example, may also contain differently sensitised interlayers, by means of which gradation may be influenced.

The substantial constituents of the photographic emulsion layers are binder, silver halide grains and colour couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Further red sensitisers which may be considered for the red-sensitive layer are pentamethinecyanines having naphthothiazole, naphthoxazole or benzothiazole as basic end groups, which may be substituted with halogen, methyl or methoxy groups and may be bridged by 9,11-alkylene, in particular 9,11-neopentylene. The N,N' substituents may be $C_4$–$C_8$ alkyl groups. The methine chain may additionally also bear substituents. Pentamethines having only one methyl group on the cyclohexene ring may also be used. The red sensitiser may be supersensitised and stabilised by the addition of heterocyclic mercapto compounds.

The red-sensitive layer may additionally be spectrally sensitised between 390 and 590 nm, preferably at 500 nm, in order to bring about improved differentiation of red tones.

The spectral sensitisers may be added to the photographic emulsion in dissolved form or as a dispersion. Both the solution and dispersion may contain additives such as wetting agents or buffers.

The spectral sensitiser or a combination of spectral sensitisers may be added before, during or after preparation of the emulsion.

Photographic print materials contain either silver chloride-bromide emulsions containing up to 80 mol % of AgBr or silver chloride-bromide emulsions containing above 95 mol % of AgCl.

Details of colour couplers maybe found in Research Disclosure 37254, part 4 (1995), page 288, in Research Disclosure 37038, part II (1995), page 80 and in Research Disclosure 38957, part X.B (1996), page 616. In print materials, the maximum absorption of the dyes formed from the couplers and the colour developer oxidation product is preferably within the following ranges: yellow coupler 440 to 450 nm, magenta coupler 540 to 560 nm, cyan coupler 625 to 670 nm.

The yellow couplers associated with a blue-sensitive layer in print materials are almost always two-equivalent couplers of the pivaloylacetanilide and cyclopropylcarbonylacetanilide series.

The magenta couplers conventional in print materials are almost always those from the series of anilinopyrazolones, pyrazolo[5,1-c](1,2,4)triazoles or pyrazolo[1,5-b](1,2,4) triazoles.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq.

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce colour fogging and to reduce yellowing, and others. Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, V, VII, X and X (1996), pages 607 and 610 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, colour photographic materials are processed using different processes depending upon their nature. Details relating to processing methods and the necessary chemicals are disclosed in Research Disclosure 37254, part 10 (1995), page 294, in Research Disclosure 37038, parts XVI to XXIII (1995), pages 95 et seq. and in Research Disclosure 38957, parts XVIII, XIX and XX (1996), pages 630 et seq. together with example materials.

EXAMPLES

Emulsions

Production of the Silver Halide Emulsions

Micrate emulsion (EmM1) (Undoped Micrate Emulsion)

The following solutions are prepared with demineralised water:

| | | |
|---|---|---|
| Solution 01 | 5500 g | water |
| | 700 g | gelatine |
| | 5 g | n-decanol |
| | 20 g | NaCl |
| Solution 02 | 9300 g | water |
| | 1800 g | NaCl |
| Solution 03 | 9000 g | water |
| | 5000 g | $AgNO_3$ |

Solutions 02 and 03 are simultaneously added with vigorous stirring to solution 01 at 40° C. over the course of 30 minutes with a constant feed rate at pAg 7.7 and pH 5.3. During precipitation, the pAg value is held constant by apportioning an NaCl solution and the pH value by apportioning $H_2SO_4$ to the precipitation tank. An AgCl emulsion having an average particle diameter of 0.09 $\mu$m is obtained. The gelatine/$AgNO_3$ weight ratio is 0.14. The emulsion is ultrafiltered at 50° C., washed and redispersed with such a quantity of gelatine and water that the gelatine/$AgNO_3$ weight ratio is 0.3 and each kg of the emulsion contains 200 g of AgCl. After redispersion, the grain size is 0.13 $\mu$m.

Red-Sensitive Emulsion EmR1

The following solutions are prepared with demineralised water:

| | | |
|---|---|---|
| Solution 11 | 1100 g | water |
| | 136 g | gelatine |
| | 1 g | n-decanol |
| | 4 g | NaCl |
| | 195 g | EmMl |
| Solution 12 | 1860 g | water |
| | 360 g | NaCl |
| | 56 μg | $K_2IrCl_6$ |
| Solution 13 | 1800 g | water |
| | 1000 g | $AgNO_3$ |

Solutions 12 and 13 are simultaneously added with vigorous stirring to solution 11, which has initially been introduced into the precipitation tank, at 40° C. over the course of 75 minutes at a pAg of 7.7. The pAg and pH values are controlled as during precipitation of emulsion EmM1. Feed is adjusted such that, over the first 50 minutes, the feed rate of solutions 12 and 13 rises in a linear manner from 4 ml/min to 36 ml/min and in the remaining 25 minutes is held at a constant feed rate of 40 ml/min. An AgCl emulsion having an average particle diameter of 0.48 μm is obtained. The quantity of AgCl in the emulsion is hereinafter converted to $AgNO_3$. The gelatine/$AgNO_3$ weight ratio is 0.14. The emulsion is ultrafiltered, washed and redispersed with such a quantity of gelatine and water that the gelatine/$AgNO_3$ weight ratio is 0.56 and each kg of the emulsion contains 200 g of $AgNO_3$.

The emulsion is chemically ripened at a pH of 5.0 with an optimum quantity of gold(III) chloride and $Na_2S_2O_3$ for 2 hours at a temperature of 75° C. After chemical ripening, the emulsion is spectrally sensitised at 40° C. with 75 μmol of compound (RS-1) per mol of AgCl and stabilised with 2.5 mmol of (ST-1) per mol of $AgNO_3$. 3 mmol of KBr are then added.

RS-1:

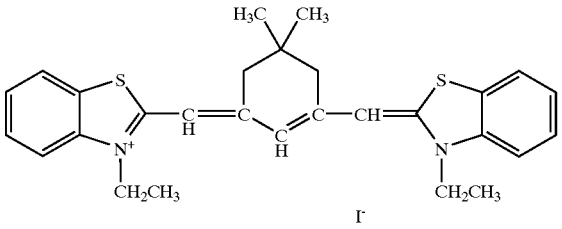

ST-1:

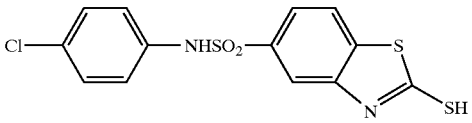

Green-Sensitive Emulsion EmG1

Precipitation, salt removal and redispersion proceed as for the red-sensitive emulsion EmR1. The emulsion is optimally ripened at a pH of 5.0 with gold(III) chloride and $Na_2S_2O_3$ for 2 hours at a temperature of 60° C. After chemical ripening, for each mol of AgCl, the emulsion is spectrally sensitised at 50° C. with 0.6 mmol of compound (GS-1), stabilised with 1.2 mmol of compound (ST-2) and then combined with 1 mmol of KBr.

GS-1:

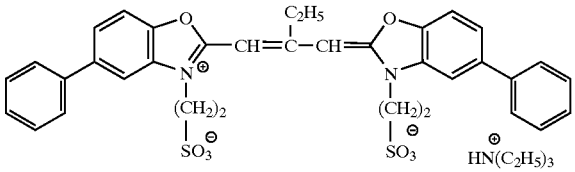

ST-2:

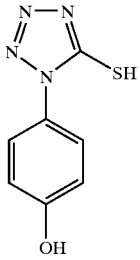

Blue-Sensitive Emulsion EmB1

The following solutions are prepared with demineralised water:

| | | |
|---|---|---|
| Solution 21 | 5500 g | water |
| | 680 g | gelatine |
| | 5 g | n-decanol |
| | 20 g | NaCl |
| | 180 g | EmMl |
| Solution 22 | 9300 g | water |
| | 1800 g | NaCl |
| Solution 23 | 9000 g | water |
| | 5000 g | $AgNO_3$ |

Solutions 22 and 23 are simultaneously added with vigorous stirring to solution 21, which has initially been introduced into the precipitation tank, at 50° C. over the course of 150 minutes at a pAg of 7.7. The pAg and pH values are controlled as during precipitation of emulsion EmM1. Feed is adjusted such that, over the first 100 minutes, the feed rate of solutions 22 and 23 rises in a linear manner from 10 ml/min to 90 ml/min and in the remaining 50 minutes is held at a constant feed rate of 100 ml/min. An AgCl emulsion having an average particle diameter of 0.85 μm is obtained. The gelatine/$AgNO_3$ weight ratio is 0.14. The emulsion is ultrafiltered, washed and redispersed with such a quantity of gelatine and water that the gelatine/$AgNO_3$ weight ratio is 0.56 and each kg of the emulsion contains 200 g of $AgNO_3$.

The emulsion is ripened at a pH of 5.0 with an optimum quantity of gold(III) chloride and $Na_2S_2O_3$ for 2 hours at a temperature of 50° C. After chemical ripening, for each mol of AgCl, the emulsion is spectrally sensitised at 40° C. with 0.3 mmol of compound BS-1, stabilised with 0.5 mmol of compound (ST-3) and then combined with 0.6 mmol of KBr.

BS-1:

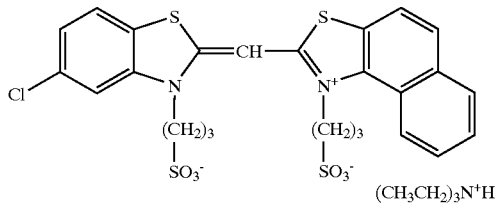

ST-3:

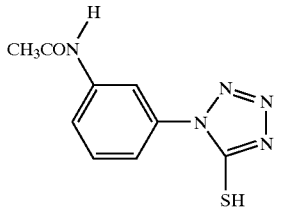

Layer Structure

Example 1

A colour photographic recording material suitable for rapid processing was produced by applying the following layers in the stated sequence onto a layer support of paper coated on both sides with polyethylene. Quantities are stated in each case per 1 $m^2$. The silver halide application rate is stated as the corresponding quantities of $AgNO_3$.

| Layer structure 101 | |
|---|---|
| Layer 1: | (Substrate layer) |
| | 0.10 g of gelatine |
| Layer 2: | (Blue-sensitive layer) |
| | Blue-sensitive silver halide emulsion EmB1 (99.94 mol % chloride, 0.06 mol % bromide, average grain diameter 0.85 $\mu$m) prepared from 0.4 g of $AgNO_3$. |
| | 1.25 g of gelatine |
| | 0.30 g of yellow coupler GB-1 |
| | 0.20 g of yellow coupler GB-2 |
| | 0.30 g of tricresyl phosphate (TCP) |
| | 0.10 g of stabiliser ST-4 |
| Layer 3: | (Interlayer) |
| | 0.10 g of gelatine |
| | 0.06 g of DOP scavenger SC-1 |
| | 0.06 g of DOP scavenger SC-2 |
| | 0.12 g of TCP |
| Layer 4: | (Green-sensitive layer) |
| | Green-sensitive silver halide emulsion EmG1 (99.9 mol % chloride, 0.1 mol % bromide, average grain diameter 0.48 $\mu$m) prepared from 0.2 g of $AgNO_3$. |
| | 1.10 g of gelatine |
| | 0.05 g of magenta coupler PP-1 |
| | 0.10 g of magenta coupler PP-2 |
| | 0.15 g of stabiliser ST-5 |
| | 0.20 g of stabiliser ST-6 |
| | 0.40 g of TCP |
| Layer 5: | (UV protective layer) |
| | 1.05 g of gelatine |
| | 0.35 g of UV absorber UV-1 |
| | 0.10 g of UV absorber UV-2 |
| | 0.05 g of UV absorber UV-3 |
| | 0.06 g of DOP scavenger SC-1 |
| | 0.06 g of DOP scavenger SC-2 |
| | 0.25 g of TCP |

-continued

| Layer structure 101 | |
|---|---|
| Layer 6: | (Red-sensitive layer) |
| | Red-sensitive silver halide emulsion EmR1 (99.7 mol % chloride, 0.3 mol % bromide, average grain diameter 0.48 $\mu$m) prepared from 0.28 g of $AgNO_3$. |
| | 1.00 g of gelatine |
| | 0.40 g of cyan coupler according to Table 1 |
| | 0.40 g of oil former according to Table 1 |
| Layer 7: | (UV protective layer) |
| | 1.05 g of gelatine |
| | 0.35 g of UV absorber UV-1 |
| | 0.10 g of UV absorber UV-2 |
| | 0.05 g of UV absorber UV-3 |
| | 0.15 g of TCP |
| Layer 8: | (Protective layer) |
| | 0.90 g of gelatine |
| | 0.05 g of optical brightener W-1 |
| | 0.07 g of polyvinylpyrrolidone |
| | 1.20 ml of silicone oil |
| | 2.50 mg of polymethyl methacrylate spacers, average particle size 0.8 $\mu$m |
| | 0.30 g of instant hardener H-1 |

The other layer structures differ from 101 with regard to the cyan couplers, oil formers and quantities of oil formers for layer 6 stated in Table 1. Table 1 summarises the results of the tests described below which were carried out on these layer structures.

Chemical Processing

All samples were processed as follows.

| | | |
|---|---|---|
| a) | Colour developer, 45 s, 35° C. | |
| | Triethanolamine | 9.0 g |
| | N,N-Diethylhydroxylamine | 4.0 g |
| | Diethylene glycol | 0.05 g |
| | 3-Methyl-4-amino-N-ethyl-N-methane-sulfonamidoethylaniline sulfate | 5.0 g |
| | Potassium sulfite | 0.2 g |
| | Triethylene glycol | 0.05 g |
| | Potassium carbonate | 22 g |
| | Potassium hydroxide | 0.4 g |
| | Ethylenediaminetetraacetic acid, disodium salt | 2.2 g |
| | Potassium chloride | 2.5 g |
| | 1,2-Dihydroxybenzene-3,4,6-trisulfonic acid trisodium salt | 0.3 g |
| | make up with water to 1000 ml; pH 10.0 | |
| b) | Bleach/fixing bath, 45 s, 35° C. | |
| | Ammonium thiosulfate | 75 g |
| | Sodium hydrogen sulfite | 13.5 g |
| | Ammonium acetate | 2.0 g |
| | Ethylenediaminetetraacetic acid (iron/ammonium salt) | 57 g |
| | Ammonia, 25% | 9.5 g |
| | make up with acetic acid to 1000 ml; pH 5.5 | |
| c) | Rinsing, 2 min, 33° C. | |
| d) | Drying | |

The percentage magenta secondary densities were then determined at cyan density $D_{cyan}$=1.0 ($SD_{magenta}$). The results are shown in Table 1.

The following compounds are used in Example 1:

GB-1
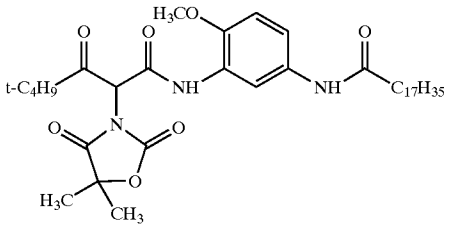
GB-2
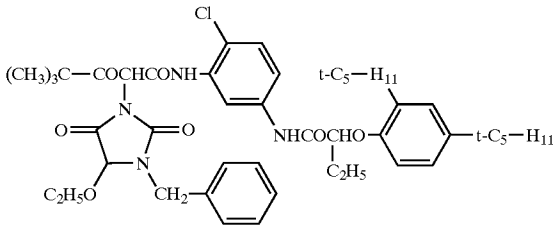
PP-1
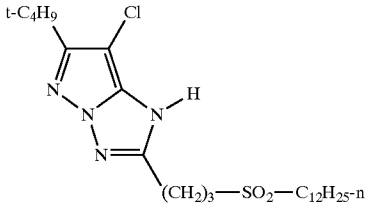
PP-2
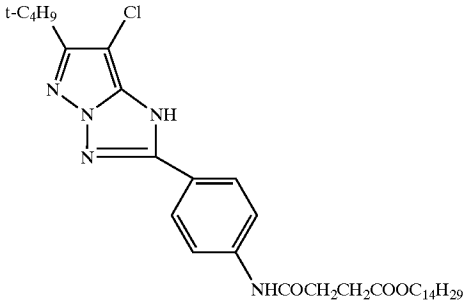
BG-1
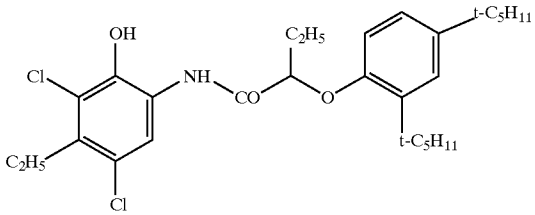
BG-2
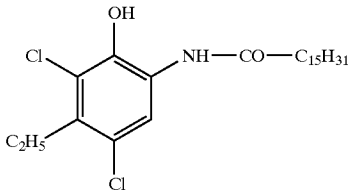
SC-1
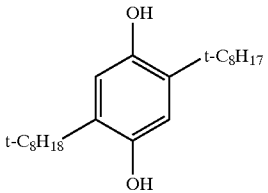

-continued
SC-2
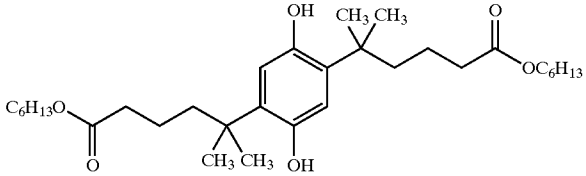
UV-1
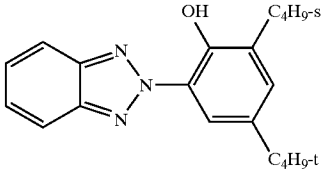
UV-2
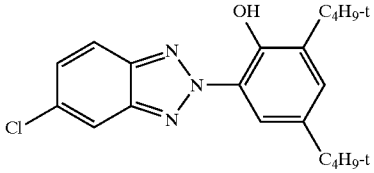
UV-3
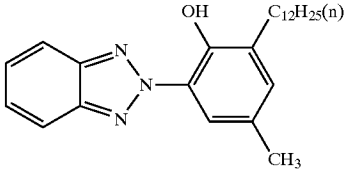
H-1
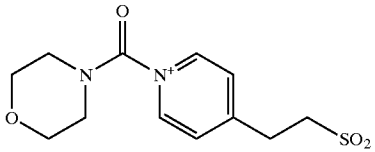
ST-4
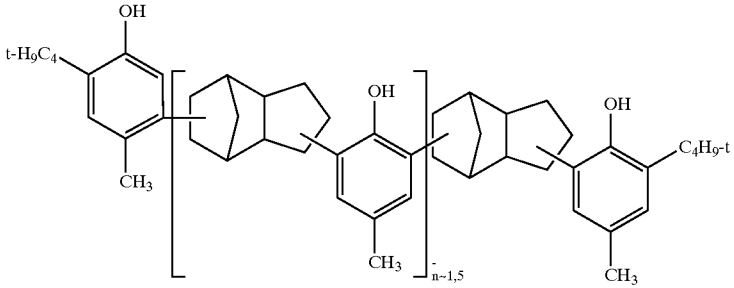
ST-5
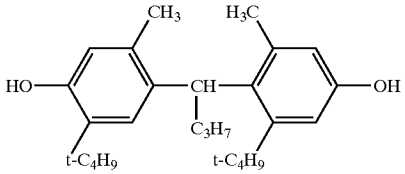
ST-6
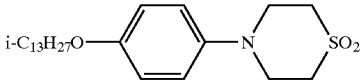

-continued
W-1
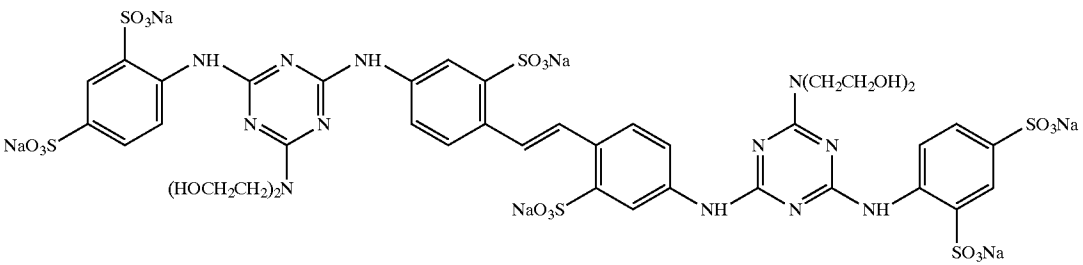

TABLE 1

| Layer structure | Cyan coupler | Oil former | Oil former quantity (g) | Oil former/ coupler ratio | Secondary density $SD_{magenta}$ (%) | |
|---|---|---|---|---|---|---|
| 101 | BG-1/BG-2 (1:3) | TCP | 0.8 | 2:1 | 28.5 | Comparison |
| 102 | BG-1/BG-2 (1:3) | TCP | 0.6 | 1.5:1 | 28.9 | Comparison |
| 103 | BG-1/BG-2 (1:3) | TCP | 0.3 | 0.75:1 | 29.8 | Comparison |
| 104 | BG-1/BG-2 (1:3) | TCP | 0.2 | 0.5:1 | 32.7 | Comparison |
| 105 | I-10 | TCP | 0.8 | 2:1 | 30.1 | Comparison |
| 106 | I-10 | TCP | 0.6 | 1.5:1 | 26.2 | Comparison |
| 107 | I-10 | TCP | 0.3 | 0.75:1 | 22.7 | Invention |
| 108 | I-10 | TCP | 0.2 | 0.5:1 | 22.0 | Invention |
| 109 | I-1 | DBP | 0.8 | 2:1 | 28.4 | Comparison |
| 110 | I-1 | DBP | 0.6 | 1.5:1 | 25.1 | Comparison |
| 111 | I-1 | DBP | 0.3 | 0.75:1 | 22.5 | Invention |
| 112 | I-1 | DBP | 0.2 | 0.5:1 | 21.9 | Invention |
| 113 | I-33 | TCP | 0.8 | 2:1 | 28.6 | Comparison |
| 114 | I-33 | TCP | 0.6 | 1.5:1 | 26.3 | Comparison |
| 115 | I-33 | TCP | 0.3 | 0.75:1 | 22.2 | Invention |
| 116 | I-33 | TCP | 0.2 | 0.5:1 | 20.9 | Invention |
| 117 | I-33 | TCP | 0.1 | 0.25:1 | 21.0 | Invention |
| 118 | I-33 | P-122 | 0.3 | 0.75:1 | 21.8 | Invention |
| 119 | I-33 | P-91/TCP (1:1) | 0.3 | 0.75:1 | 21.3 | Invention |

The oil former named "DBP" in the Table is dibutyl phthalate.

As is clear from Table 1, reducing the quantity of oil former surprisingly brings about a distinct improvement in the colour reproduction of the cyan couplers according to the invention, unlike the comparison couplers, and thus satisfies the most stringent requirements.

What is claimed is:

1. A print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterized in that the red-sensitive layer contains at least one oil former, the cyan coupler is of the formula

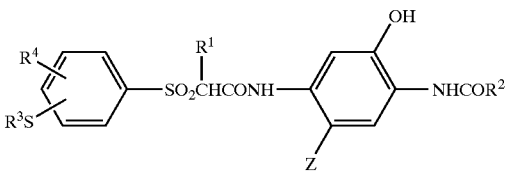

(I)

in which $R^1$ means a hydrogen atom or an alkyl group, $R^2$ means an alkyl, aryl or hetaryl group, $R^3$ means an alkyl or aryl group, $R^4$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom and Z means a hydrogen atom or a group eliminable under the conditions of chromogenic development, and the ratio by weight of oil former to cyan coupler is less than 0.8:1.

2. A print material according to claim 1, characterised in that it is a colour negative material.

3. The print material according to claim 1, wherein the cyan coupler is of the formula (I-A)

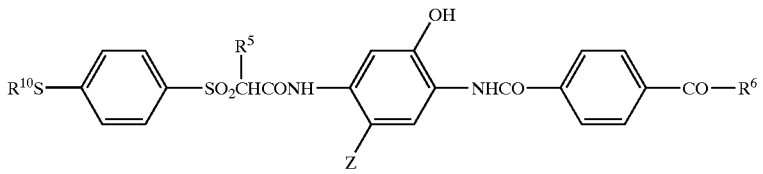

in which $R^5$ means a hydrogen atom or an alkyl group, $R^6$ means $OR^7$ or $NR^8R^9$, $R^7$ means an unsubstituted or substituted alkyl group with 1 to 6 C atoms, $R^8$ means an unsubstituted or substituted alkyl group with 1 to 6 C atoms, $R^9$ means a hydrogen atom or an unsubstituted or substituted alkyl group with 1 to 6 C atoms, $R^{10}$ means an unsubstituted or substituted alkyl group and Z means a hydrogen atom or a group eliminable under the conditions of chromogenic development, wherein the total number of the C atoms of the alkyl groups $R^7$ to $R^{10}$ in a coupler molecule is 8 to 18.

4. The print material according to claim 1, wherein the oil former comprises a high-boiling organic solvent and/or a polymer.

5. The print material according to claim 1, wherein the ratio by weight of oil former: cyan coupler is at least 0.05:1.

6. The print material according to claim 1, wherein the oil former is a high-boiling organic solvent.

7. The print material according to claim 5, wherein the polymer comprises homo- or copolymer, which is insoluble in water and soluble in organic solvents.

8. The print material according to claim 1, wherein the silver halide crystals of the red-sensitive layer have a chloride content of at least 95 mol %.

9. A process for the production of a positive reflection print from a color negative, which comprises exposing an image information onto the print material as claimed in claim 1.

10. The process according to claim 9, wherein the color negative is digitized and exposure is performed with a scanning printer.

11. The process according to claim 9, wherein the exposing is performed with an analogue printer.

* * * * *